US005797222A

United States Patent [19]

Martin

[11] Patent Number: 5,797,222

[45] Date of Patent: Aug. 25, 1998

[54] EXTENDED RIDGE ROOF VENT

[76] Inventor: Paul Martin, P.O. Box 563, Wampsville, N.Y. 13163

[21] Appl. No.: 900,587

[22] Filed: Jul. 25, 1997

[51] Int. Cl.[6] ..... E04B 7/00

[52] U.S. Cl. ..... 52/198; 52/57; 454/365

[58] Field of Search ..... 52/43, 44, 57, 52/198, 199, 302.1; 454/365, 366, 900

[56] References Cited

U.S. PATENT DOCUMENTS 4,903,445 2/1990 Mankowski .
5,050,489 9/1991 Mankowski .
5,339,582 8/1994 Sells .

FOREIGN PATENT DOCUMENTS 2136558 9/1984 United Kingdom ..... 454/365

*Primary Examiner*—Creighton Smith
*Attorney, Agent, or Firm*—Harpman & Harpman

[57] ABSTRACT

A roof and gable extension ventilation device having primary and secondary vent openings as a barrier against wind blown moisture. The device extends along and over an opening in the ridge of the roof and beyond the roof end gable for increased venting efficiency. Multiple intermediate sections can be added for increased length with flexible end caps.

8 Claims, 4 Drawing Sheets

EXTENDED RIDGE ROOF VENT

BACKGROUND OF THE INVENTION

1. Technical Field

This device relates to roof venting requirements in the housing and building industry where it is necessary to provide roof ventilation in the attic. Ventilation enters the attic through intake vents and exits through roof vents located along the ridge of the roof.

2. Description of Prior Art

Prior art devices of this type have relied on a variety of different roof venting configurations, see for example U.S. Pat. Nos. 4,903,445, 5,050,489 and 5,339,582.

In U.S. Pat. No. 4,903,445, a ridge roof ventilator is disclosed having a plurality of interior vent openings separated by intermediate dividing walls in communication with a large open area with drainage slots associated therewith.

In U.S. Pat. No. 5,050,489 a roof ventilator is shown having a contoured substantially rounded outer cover with a nailing flange and a vent located in the cover member to permit air circulation through the roof or roof ridge. Interior and exterior venting openings are provided in this device to prevent the penetration of moisture and to provide adequate ventilation to the roof.

Finally, in U.S. Pat. No. 5,339,582 a roof vent is disclosed which is positioned over two parallel vent openings in the roof on either side of the ridge and provides venting through interior vents with a contoured weather cover positioned thereover.

SUMMARY OF THE INVENTION

This invention is directed to the ventilation of roofs to eliminate excess moisture and heat in attic space that is detrimental to roof materials and performance. The ridge vent is positioned over an opening in the roof having louvers and secondary interior louver panels to prevent water infiltration. An end gable extension provides additional venting area to enhance the efficiency of the venting device. Additional ridge vent extensions can be added incrementally by the use of end cap joining fittings to provide multiple extensions depending on the length of the roof required.

DESCRIPTION OF THE PREFERRED EMBODIMENT

Figure 1:
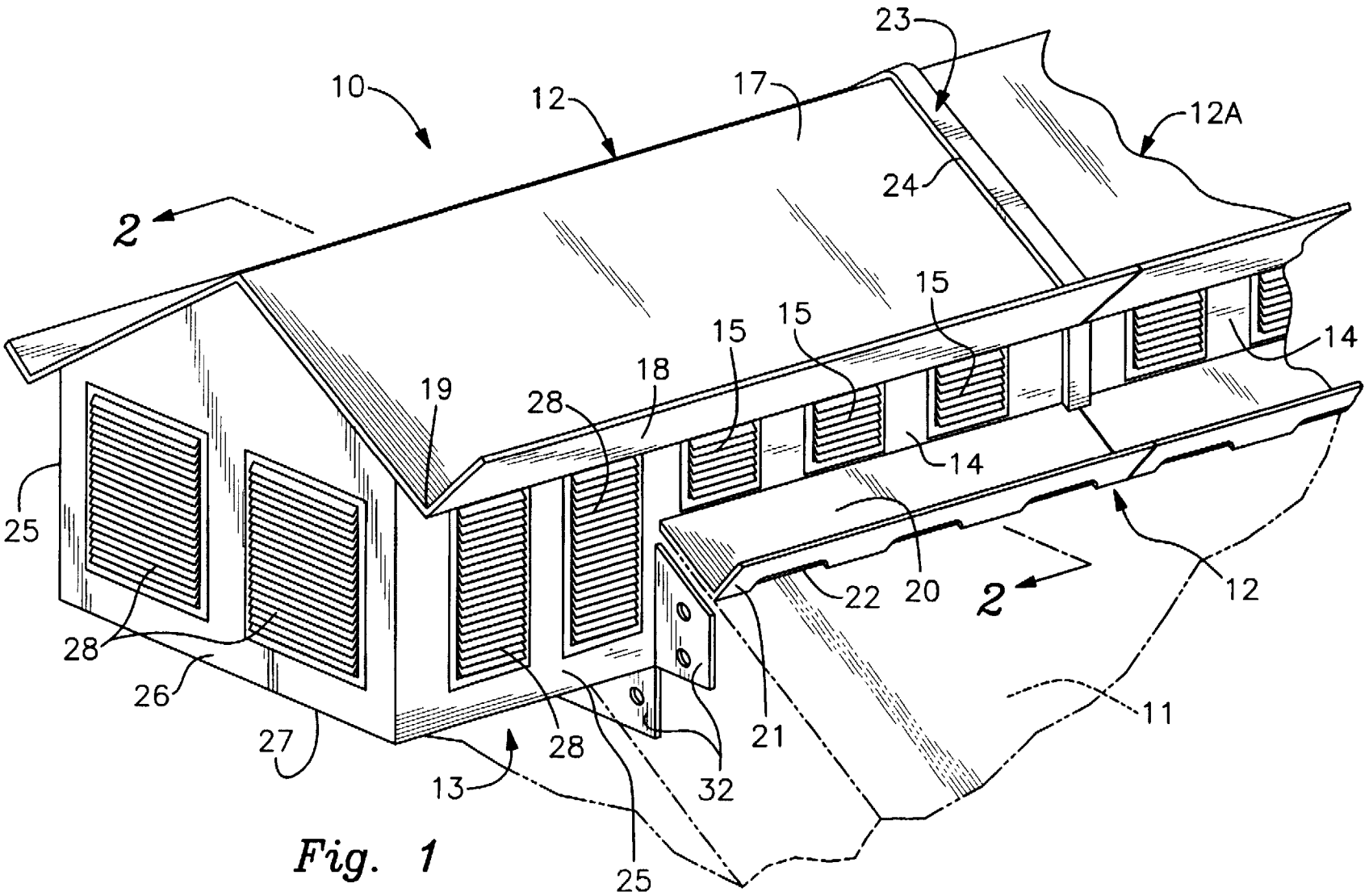
FIG. 1 is a perspective gable end view of the roof vent of the invention on a roof.
Figure 2:
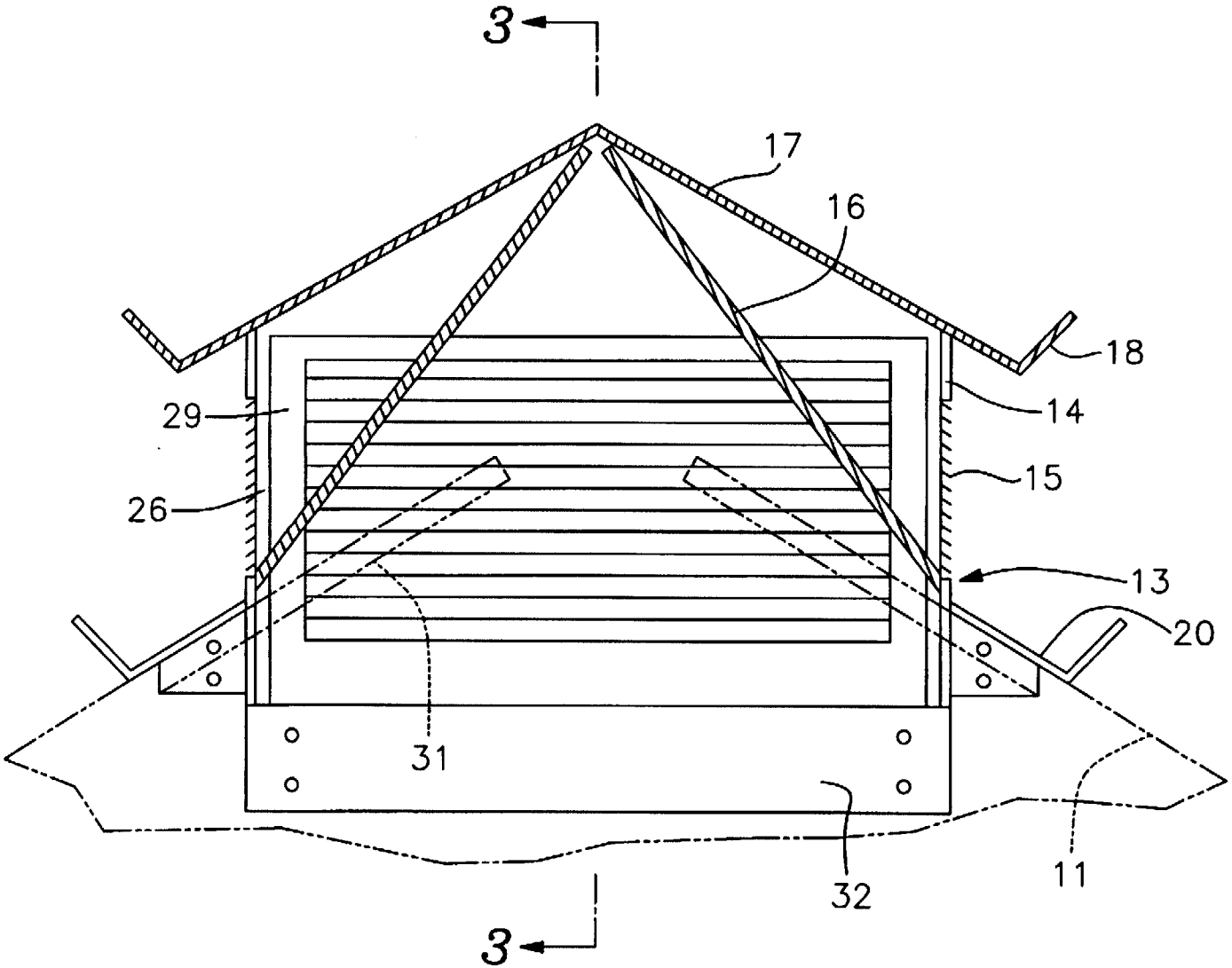
FIG. 2 is an end plan view of the roof vent with the roof shown in broken lines.

Referring to FIGS. 1 and 2 of the drawings, a roof vent 10 of the invention can be seen installed on a fragmented portion of a roof 11. The roof vent 10 has a ridge vent portion 12 and a gable extension portion 13. The ridge vent portion 12 has a pair of upstanding sidewalls 14, portions of which are louvered at 15 extending longitudinally along their surface.

Interior return walls 16 extend from the respective sidewalls 14 in angularly disposed relation thereto. The interior return walls 16 are also louvered in spaced sections therealong and are provided to prevent the penetration of wind driven rain and moisture to the vent by being positioned in offset relation to one another.

An angled top element 17 extends between and beyond the sidewalls 14 forming a weather resistant enclosure. The top element 17 has elongated return flanges 18 along its respective perimeter free edges 19. A nailing flange 20 extends from the respective sidewalls 14 and also has an elongated end return flange 21 thereon. The nailing flanges 20 have a plurality of longitudinally spaced slots 22 therein to afford proper drainage as will be well understood by those skilled in the art.

A flexible end cap 23 is provided to seal the open end of the roof vent portion 12 by a perimeter engagement therewith and to provide a flange 24 for registration thereon. The end cap 23 also allows additional roof vent extension portions (not shown) to be interconnected to form a vent structure of any desirable length.

Figure 3:
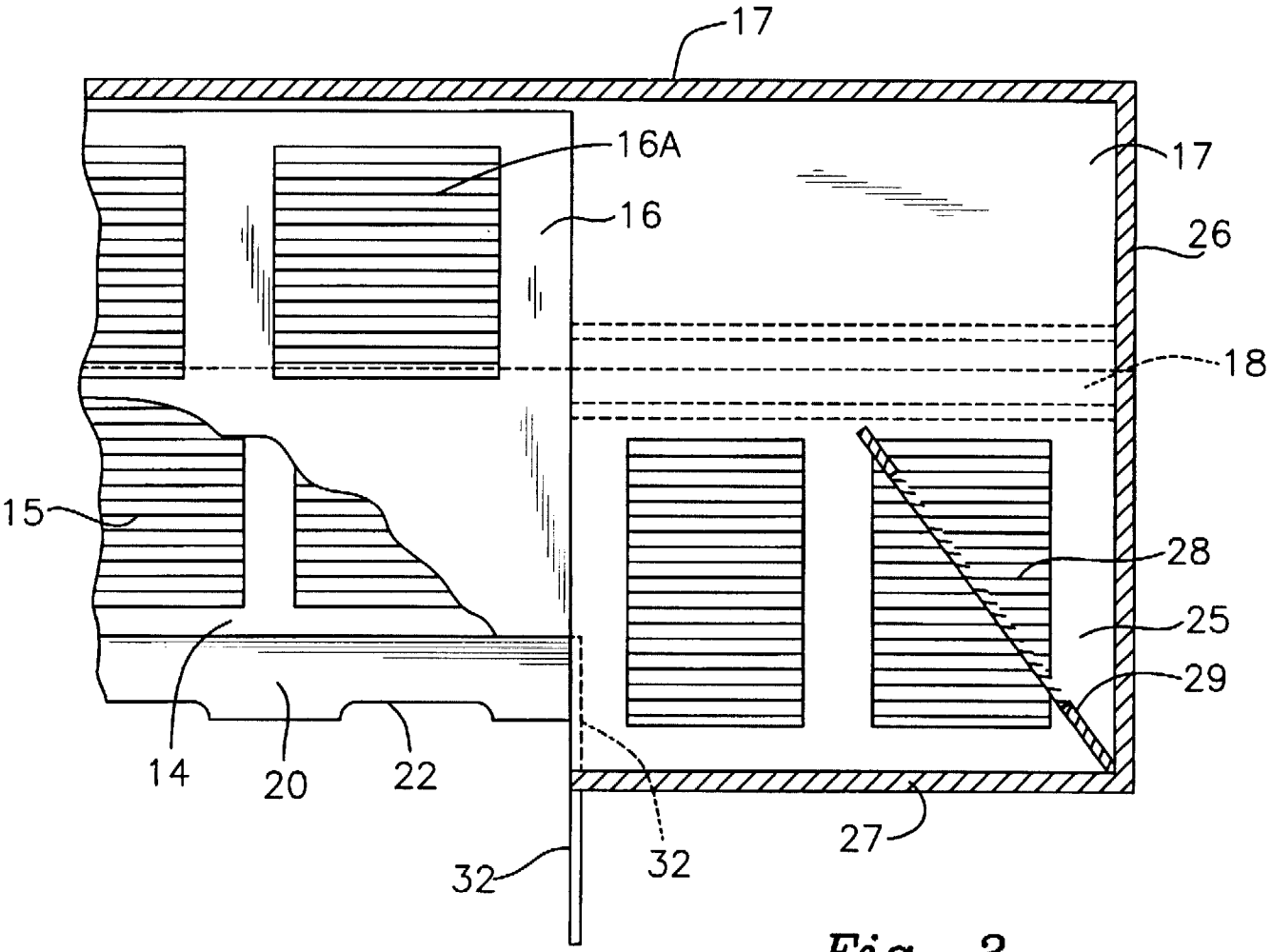
FIG. 3 is a partial cross-sectional view on lines 3—3 of FIG. 2.

The gable extension portion 13 best seen in FIGS. 1–3 of the drawings has contiguous sidewalls extending from the respective sidewalls 25 with an end gable wall 26 and integral bottom 27 defining multiple wall enclosure. The top element 17 extends out over the gable enclosure portion 13 defining the completed roof vent 10 of the invention.

The enclosure's sidewalls 25 and end gable wall 26 each have ventilation louvers 28 formed therein. A louver return end gable interior wall 29 extends angularly from said end gable wall 26, best seen in FIGS. 2 and 3 of the drawings, to provide water infiltration barrier against gable driven rain.

Figure 4:
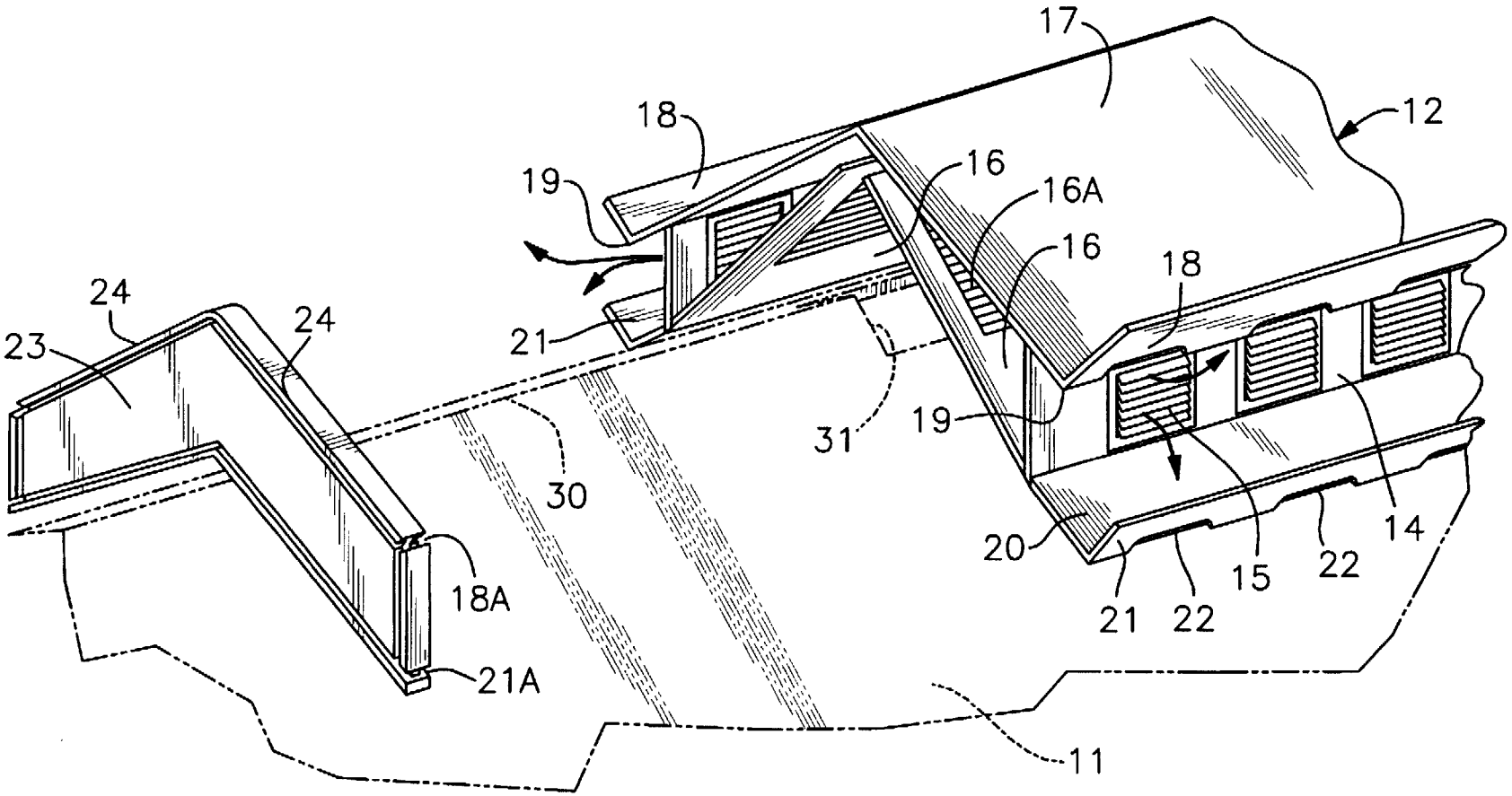
FIG. 4 is a perspective roof ridge view of the vent of the invention with an end cap removed therefrom.

The roof vent 10 is positioned on the gable end of the roof overlying the roof ridge 30 which is typically cut-away at 31 for ventilation purposes, as best seen in FIG. 4 of the drawings. Additional nailing flanges 32 extend from the gable vent portion 13 to help secure the roof vent 10 of the invention to the roof 11.

Referring now to FIG. 3 of the drawings, it will be seen that the interior return walls 16 are only louvered above the corresponding louvers 15 in the respective sidewalls 14 assuring the roof vent 31 will stay dry.

It will be evident from the above description that the roof vent 10 of the invention can be made of sheet aluminum or molded synthetic resin material dependent on the application and desired design characteristics envisioned by the user.

It will therefore be seen that a new and novel ridge vent roof system to prevent the infiltration of wind driven rain and moisture has been illustrated and described and it will be apparent to those skilled in the art that various changes and modifications may be made therein without departing from the spirit of the invention.

Therefore I claim:

1. A ridge roof vent to be positioned over a vent opening in a roof ridge, and to extend therebeyond over a gable end of the roof comprises; a ridge vent portion and a gable extension portion, said ridge vent portion having a pair of spaced parallel upstanding sidewalls, a plurality of vent openings in said sidewalls, interior return vent walls extending from said sidewalls with vent openings therein, flanges extending from said sidewalls onto said roof, said gable extension portions comprising; a pair of sidewalls, internal end gable wall and wall bottom member, said side and gable walls having vent openings therein, a top extending between and over said respective sidewalls, means for securing said gable portion to said top and means for extending said ridge vent portions along said ridge vent.

2. The ridge roof vent of claim 1 wherein said interior return vent walls extend in angular relation to said upstanding sidewalls.

3. The ridge roof vent of claim 1 wherein said vent openings in said interior return vent walls are in spaced vertical offset relation to said vent openings in said upstanding sidewalls to prevent wind driven moisture from entering the vent opening in the roof.

4. The ridge roof vent of claim 1 wherein said attachment flanges have elongated slotted return flanges extending therefrom.

5. The ridge roof vent of claim 1 wherein said means for securing said gable portion to said roof comprises; a plurality of nailing flanges extending therefrom.

6. The ridge roof vent of claim 1 wherein said means for extending said ridge vent portion comprises; an end cap fitting.

7. The ridge roof vent of claim 6 wherein said end cap fitting is resilient and having oppositely disposed registering flanges.

8. The ridge roof vent of claim 1 wherein said top extends beyond said respective sidewalls and has an elongated return flange.

* * * * *